US010426211B1

(12) United States Patent
Rastinehad

(10) Patent No.: US 10,426,211 B1
(45) Date of Patent: Oct. 1, 2019

(54) HEADGEAR TO ASSIST A CHILD ON THE SHOULDERS OF THE WEARER

(71) Applicant: Ardeshir R. Rastinehad, New York, NY (US)

(72) Inventor: Ardeshir R. Rastinehad, New York, NY (US)

( * ) Notice: Subject to any disclaimer, the term of this patent is extended or adjusted under 35 U.S.C. 154(b) by 0 days.

(21) Appl. No.: 16/418,114

(22) Filed: May 21, 2019

(51) Int. Cl.

| | |
|---|---|
| ***A42B 1/06*** | (2006.01) |
| ***A42B 1/00*** | (2006.01) |
| ***A42B 1/02*** | (2006.01) |
| *A42B 1/24* | (2006.01) |

(52) U.S. Cl.
CPC ..... *A42B 1/006* (2013.01); *A42B 1/02* (2013.01)

(58) Field of Classification Search
CPC .... A47D 13/025; A47D 13/02; A47D 15/005; A63B 23/025; A63B 21/065; A63B 21/4003; A63B 71/10; A42B 3/0406; A42B 1/004; A42B 1/24; A42B 3/003; A42B 3/04; A42B 3/08; A42B 3/0473; A42B 3/328; A42B 1/006; A42B 1/02; A45F 3/02; A45F 3/14; B62J 11/005
See application file for complete search history.

(56) References Cited

U.S. PATENT DOCUMENTS 1,264,706 A * 4/1918 Stallworth ..... A62B 18/04 128/201.24
3,610,489 A 10/1971 Parsons
3,698,608 A * 10/1972 Entwistle ..... A47D 13/025 224/159
3,707,004 A * 12/1972 Kapitan ..... A42B 3/0473 2/2.5
3,968,910 A * 7/1976 Dye ..... A47D 13/025 224/161
4,416,403 A 11/1983 Johnson
4,484,700 A * 11/1984 Bush ..... A47D 13/025 224/159
4,566,292 A * 1/1986 Parmet ..... F25D 3/08 215/286
5,044,017 A * 9/1991 Kirby ..... B63C 11/06 2/421
5,088,633 A * 2/1992 Cunard ..... B62J 11/005 224/418
5,335,834 A * 8/1994 Verina ..... A47D 13/025 224/159
5,437,402 A * 8/1995 Ring ..... A47D 13/025 128/882
6,000,065 A * 12/1999 Deagan ..... A42B 3/328 2/410
6,098,856 A * 8/2000 Reilly ..... A47D 13/025 224/159
6,186,381 B1 * 2/2001 Kernkamp ..... A47D 13/025 224/159

(Continued)

*Primary Examiner* — Robert H Muromoto, Jr.
(74) *Attorney, Agent, or Firm* — Dunlap Bennett & Ludwig PLLC

(57) ABSTRACT

A handle headgear secures handles and straps to the head of a wearer so that a child riding on the back of the wearer can grab the handles and strap for support. The handle headgear may provide frame strapping for supporting the handles and straps, wherein the frame strapping can be anchored to the head of wearer with chin straps provided by the frame strapping. A substructure may be joined to the frame strapping for further securing the handles and straps.

10 Claims, 4 Drawing Sheets

(56) References Cited

U.S. PATENT DOCUMENTS 6,256,799 B1 * 7/2001 McGlasson ..... A42B 3/003 2/411
6,368,293 B1 * 4/2002 Orgeron ..... A61H 7/006 601/15
6,561,394 B2 5/2003 Pripps et al.
6,887,120 B2 * 5/2005 Shamitoff ..... A63H 3/46 24/662
7,398,562 B2 * 7/2008 Mollo ..... A42B 3/0406 2/209.13
7,779,833 B2 * 8/2010 Ginn ..... B63C 11/06 128/201.27
8,056,779 B1 * 11/2011 Brunwin ..... A47D 13/025 224/160
8,209,782 B1 * 7/2012 Henry ..... A42B 3/0406 2/209.13
8,733,602 B1 * 5/2014 Bostic ..... A47D 13/02 224/159
9,498,675 B2 * 11/2016 Walworth ..... A63B 23/025
9,603,465 B2 * 3/2017 Winger ..... A47D 13/025
9,629,477 B2 4/2017 Tagle
9,789,350 B1 * 10/2017 Wu ..... A63B 21/065
2005/0045674 A1 3/2005 Rehbein
2005/0198725 A1 * 9/2005 Mollo ..... A42B 1/004 2/422
2008/0041905 A1 * 2/2008 Cavett ..... A45C 13/30 224/580
2008/0109948 A1 * 5/2008 Snir ..... A42B 3/003 2/414
2008/0271227 A1 * 11/2008 Mollo ..... A42B 1/004 2/422
2009/0050147 A1 * 2/2009 Ginn ..... B63C 11/02 128/201.27
2009/0200346 A1 * 8/2009 Long ..... A47D 13/025 224/158
2011/0100750 A1 * 5/2011 McCracken ..... A47D 13/025 182/3
2012/0018467 A1 * 1/2012 Chiappini ..... A47D 13/025 224/158
2012/0165169 A1 * 6/2012 Gatherer ..... A63B 71/0054 482/139
2016/0143384 A1 * 5/2016 Moreau ..... A42B 3/08 2/410
2018/0104142 A1 * 4/2018 Assaly ..... A61H 33/0087

* cited by examiner

HEADGEAR TO ASSIST A CHILD ON THE SHOULDERS OF THE WEARER

BACKGROUND OF THE INVENTION

The present invention relates to parenting aids and, more particularly, to a support structure that can function as a hat or be placed within an existing hat, enabling a child to grab while on the shoulders of the wearer.

The pain and discomfort associated with the pulling and tugging on one's ears and hair while giving children rides on one's shoulders can deter even the biggest-hearted parent from giving piggyback rides or shoulder rides. Conventional hats tend to fall off and/or offer no protection or anchor for the child to grab on to.

As can be seen, there is a need for a support structure that can function as a hat or be placed within an existing hat, enabling a child to grab while on the shoulders of the wearer. The present invention embodies headgear that protects the wearer from the hair pulling, head slapping, drool and other trauma involved in giving a child a ride on one's shoulders or back.

The headgear provides straps and structures for children to grab on to while riding on their parent's shoulders, reducing the pain experienced by the ride giver. The systemic headgear can be associated with a preexisting hat, further support the child rider in what can be a precarious seat.

SUMMARY OF THE INVENTION

In one aspect of the present invention, a handle headgear for securing handles to a head of a wearer so that child on a back of the wearer can grip said handles, includes the following: a frame strapping dimensioned and adapted to extend laterally across the skull of a human wearer, wherein opposing ends of the frame strapping are disposed adjacent to the two ears of the human wearer; and the frame strapping comprises two spaced apart post straps and a plurality of rung straps extending between the two spaced apart post straps; first and second handles upwardly extending from one of the two spaced apart post straps so as to be disposed at, near, along or just adjacent to the boundary of the frontal and parietal portions of the wearer's skull, wherein the first and second handles are disposed just leftward and just rightward of a longitudinal centerline of said skull.

In another aspect of the present invention, handle headgear for securing handles to a head of a wearer so that child on a back of the wearer can grip said handles, includes the following: a frame strapping dimensioned and adapted to extend laterally across the skull of a human wearer, wherein opposing ends of the frame strapping are disposed adjacent to the two ears of the human wearer; the frame strapping comprises two spaced apart post straps and a plurality of rung straps extending between the two spaced apart post straps; a first continuous handle and a second continuous handle, each continuous handle upwardly extending from one of the two spaced apart post straps so as to be disposed at, near, along or just adjacent to the boundary of the frontal and parietal portions of the wearer's skull, wherein the first and second handles are disposed just leftward and just rightward of a longitudinal centerline of said skull, wherein the first and second handles are leftward and rightward of said longitudinal centerline by approximately two to four inches; a discontinuous center handle located adjacent to said longitudinal centerline, wherein a distal end thereof extends rearward; and a substructure dimensioned and adapted to substantially cover the head of the wearer, wherein the substrate and the frame strapping are joined; and wherein an outer shell overlays the frame strapping.

In yet another aspect of the present invention method of making a hat conducive for providing a grip to a child riding on a back of a wearer of the hat, including the following: providing the above-mentioned handle headgear; cutting a plurality of holes in said hat so that the continuous handles and the center handles protrude through said plurality of holes; and wearing both said handle headgear and said hat simultaneously.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a handle headgear for securing handles and straps to the head of a wearer so that a child riding on the back of the wearer can grab the handles and strap for support. The handle headgear may provide frame strapping for supporting the handles and straps, wherein the frame strapping can be anchored to the head of wearer with chin straps provided by the frame strapping. A substructure may be joined to the frame strapping for further securing the handles and straps.

Figure 1:
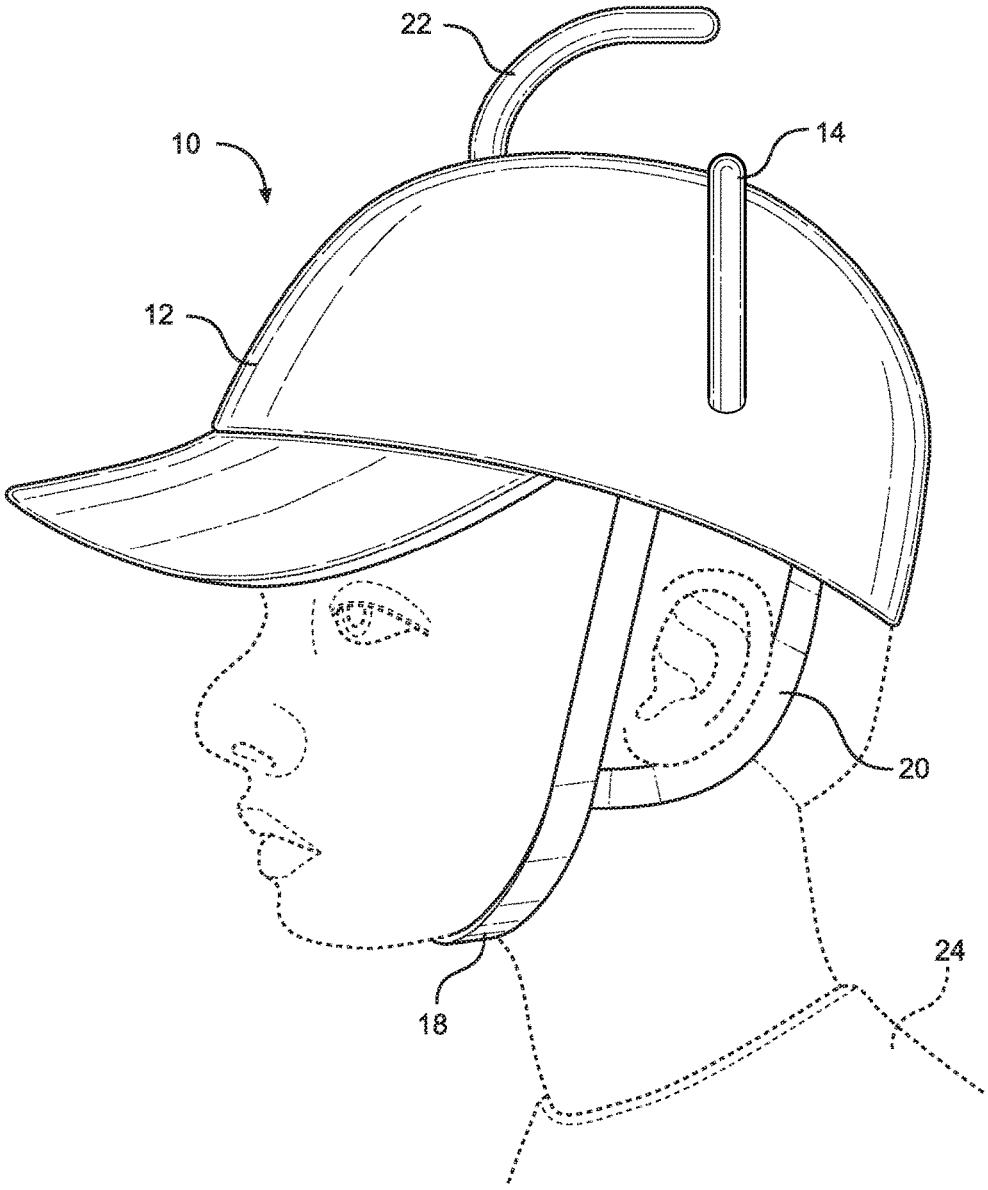
FIG. 1 is a side elevation view of an exemplary embodiment of the present invention.
Figure 2:
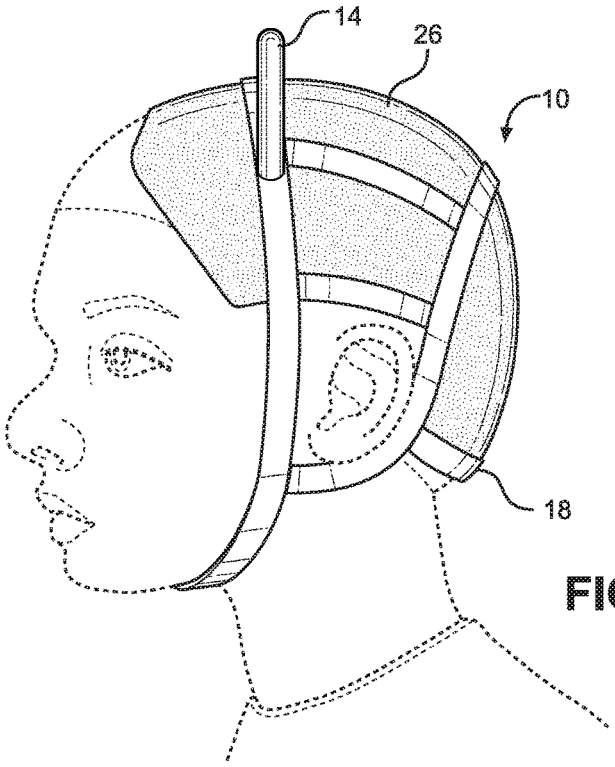
FIG. 2 is a side elevation view of an exemplary embodiment of a substructure of the present invention.
Figure 3:
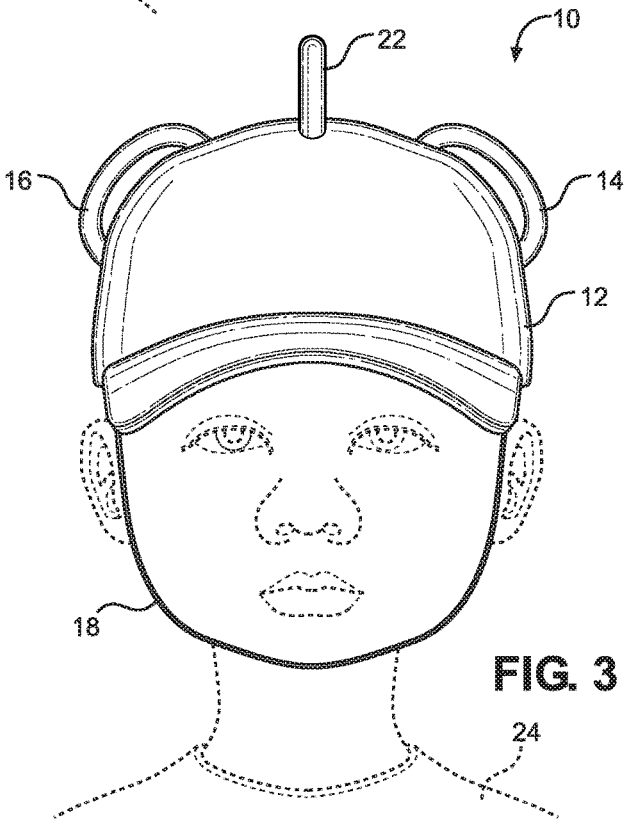
FIG. 3 is a front elevation view of an exemplary embodiment of the present invention.
Figure 4:
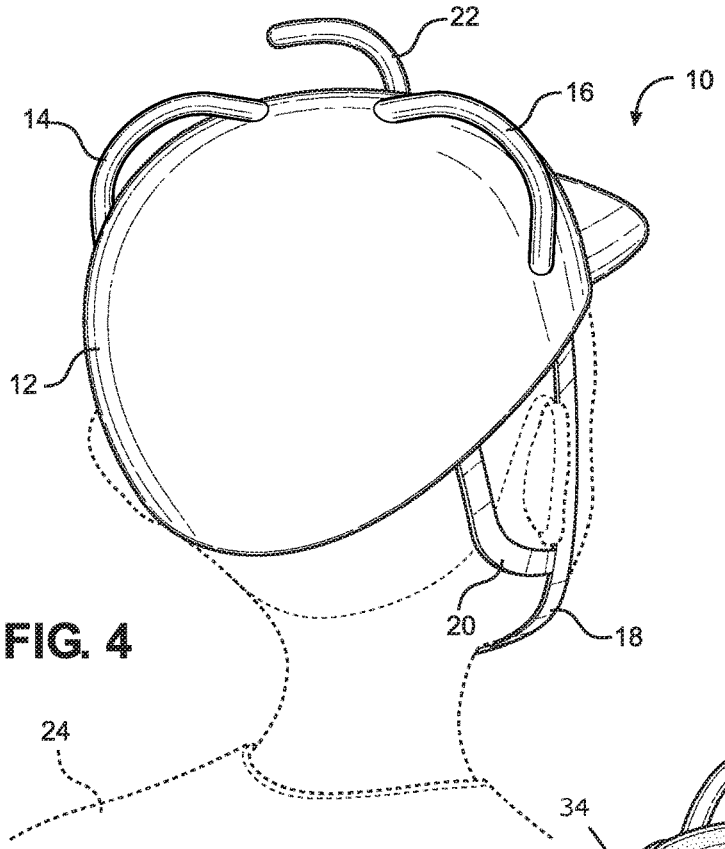
FIG. 4 is a rear perspective view of an exemplary embodiment of the present invention.
Figure 5:
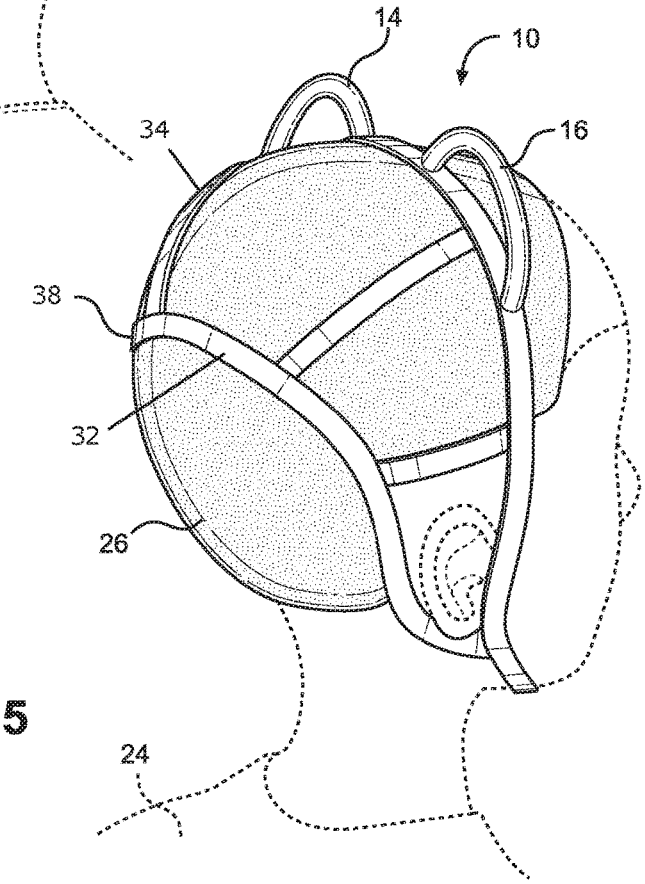
FIG. 5 is a rear perspective view of an exemplary embodiment of the substructure of the present invention.
Figure 6:
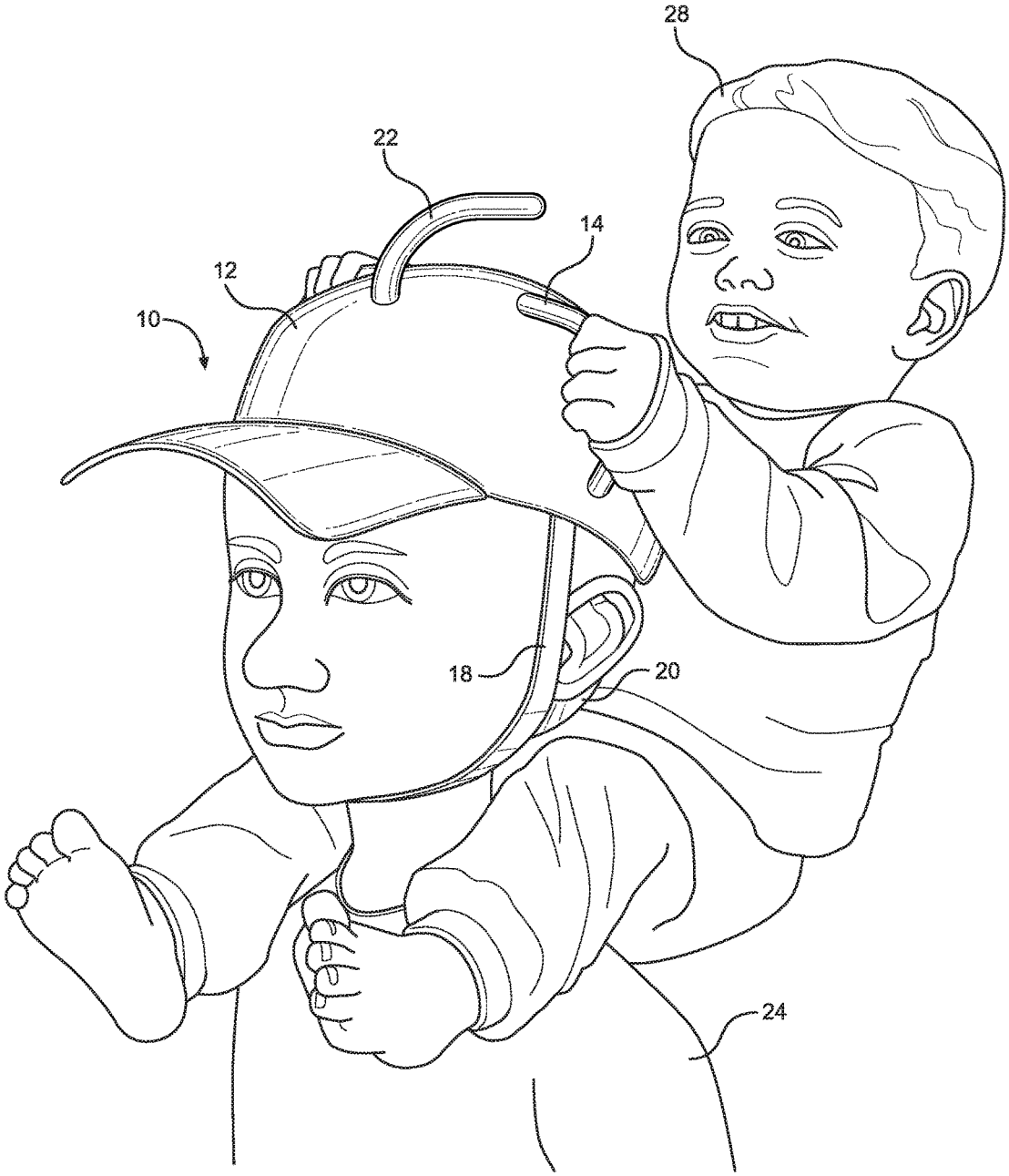
FIG. 6 is a perspective view of an exemplary embodiment of the present invention, shown in use.

Referring to FIGS. 1 through 6, the present invention may include handle headgear 10 for providing support grips for a child 28 being carried on the shoulders or back of the wearer the handle headgear 10. The handle headgear 10 is dimensioned and adapted to at least laterally extend across a head of a human wearer 24, typically ear to ear, as illustrated in FIG. 5. The handle headgear 10 may provide frame strapping 38 defined by a ladder arrangement, with two spaced-apart framing "posts" straps 32 and spaced-apart framing "rungs" straps 34 extending therebetween. It being understood that the post straps 32 and rung straps 34 are pliable enough to conform to the wearer's head and comfortable enough to wear. The opposing ends of the frame strapping 38 are typically adjacent to the wearer's ears during use. Each end may provide an ear strap 20 and/or chin strap 18 that can be removably fastened about the chin of the wearer 24 to anchor the handle headgear 10 to the wearer 24.

In certain embodiments, a substructure 26 may be integrated to the frame strapping 38, wherein the substructure is dimensioned and adapted to substantially cover the head of the wearer 24. In other embodiments, there may be an outer shell 12 dimensioned and adapted to substantially cover the head of the wearer 24, including the substructure 26.

Extending upwardly from the frame strapping 38 may be a first and second handles 14 and 16. Typically, the first and second handles 14 and 16 will extend from a framing rung 34 so as to be disposed at, near, along or just adjacent to the boundary of the frontal and parietal portions of the wearer's skull. The first and second handles 14 and 16 may be disposed just leftward and just rightward of the longitudinal centerline of said skull, wherein the leftward and rightward offset is approximately two to four inches. The first and second handles 14 and 16 may be continuous, as illustrated in the Figures. The handle headgear 10 may provide a discontinuous center handle 22 adapted to be disposed along the centerline of said skull. The distal end of the center handle 22 may be oriented rearward. The handles 14, 16 and 22 can be joined to the substructure 26 by various joining methods, such as stitching, adhesive, snaps, button or any fasteners know in the art to join one object to another.

The substructure 26 may be placed on the wearer's head. The chinstraps 18 are then fastened to anchor the substructure 26 to the head of the wearer 24. The straps and head covering are then able to be used by a child 28 to grab and play with. Thereby the handle headgear 10 protects the wearer from head slapping, hair pulling, drool, and ear pulling (not to be used as a replacement for parental supervision and holding infant). The substructure 26 could also be used with an existing hat by cutting openings in the existing hat so that the handles 14, 16, and/or 22 can protrude therethrough.

It should be understood by those skilled in the art that the use of directional terms such as upper, lower, upward, downwardly, top and the like are used in relation to the illustrative embodiments as they are depicted in the figures, the upward direction (or upper) being toward the top of the corresponding figures and a downward direction being toward the bottom of the corresponding figures.

It should be understood, of course, that the foregoing relates to exemplary embodiments of the invention and that modifications may be made without departing from the spirit and scope of the invention as set forth in the following claims.

What is claimed is:

1. A handle headgear for securing handles to a head of a wearer so that child on a back of the wearer can grip said handles, comprising:

a frame strapping dimensioned and adapted to extend laterally across the skull of a human wearer, wherein opposing ends of the frame strapping are disposed adjacent to the two ears of the human wearer; and the frame strapping comprises two spaced apart post straps and a plurality of rung straps extending between the two spaced apart post straps;

first and second handles upwardly extending from one of the two spaced apart post straps so as to be disposed at, near, along or just adjacent to the boundary of the frontal and parietal portions of the wearer's skull, wherein the first and second handles are disposed just leftward and just rightward of a longitudinal centerline of said skull.

2. The handle headgear for securing handles and straps to a head of a wearer so that child on a back of the wearer can grip said handles of claim 1, wherein the first and second handles are leftward and rightward of said longitudinal centerline by approximately two to four inches.

3. The handle headgear for securing handles to a head of a wearer so that child on a back of the wearer can grip said handles of claim 1, further comprising a center handle located adjacent to said longitudinal centerline.

4. The handle headgear for securing handles to a head of a wearer so that child on a back of the wearer can grip said handles of claim 1, wherein the first and second handles are continuous.

5. The handle headgear for securing handles to a head of a wearer so that child on a back of the wearer can grip said handles of claim 1, wherein the center handle is discontinuous so that a distal end thereof extends rearward.

6. The handle headgear for securing handles to a head of a wearer so that child on a back of the wearer can grip said handles of claim 1, further comprising a substructure dimensioned and adapted to substantially cover the head of the wearer, wherein the substrate and the frame strapping are joined.

7. The handle headgear for securing handles to a head of a wearer so that child on a back of the wearer can grip said handles of claim 1, further comprising an outer shell overlaying the frame strapping.

8. A handle headgear for securing handles to a head of a wearer so that child on a back of the wearer can grip said handles, comprising:

a frame strapping dimensioned and adapted to extend laterally across the skull of a human wearer, wherein opposing ends of the frame strapping are disposed adjacent to the two ears of the human wearer;

the frame strapping comprises two spaced apart post straps and a plurality of rung straps extending between the two spaced apart post straps;

a first continuous handle and a second continuous handle, each continuous handle upwardly extending from one of the two spaced apart post straps so as to be disposed at, near, along or just adjacent to the boundary of the frontal and parietal portions of the wearer's skull, wherein the first and second handles are disposed just leftward and just rightward of a longitudinal centerline of said skull, wherein the first and second handles are leftward and rightward of said longitudinal centerline by approximately two to four inches;

a discontinuous center handle located adjacent to said longitudinal centerline, wherein a distal end thereof extends rearward; and a substructure dimensioned and adapted to substantially cover the head of the wearer, wherein the substrate and the frame strapping are joined.

9. The handle headgear for securing handles to a head of a wearer so that child on a back of the wearer can grip said handles of claim 8, further comprising an outer shell overlaying the frame strapping.

10. A method of making a hat conducive for providing a grip to a child riding on a back of a wearer of the hat, comprising:

providing the handle headgear of claim 8;

cutting a plurality of holes in said hat so that the continuous handles and the center handles protrude through said plurality of holes; and wearing both said handle headgear and said hat simultaneously.

* * * * *